US008555627B2

(12) United States Patent
Knollmayr et al.

(10) Patent No.: US 8,555,627 B2
(45) Date of Patent: Oct. 15, 2013

(54) EXHAUST GAS LINE OF AN INTERNAL COMBUSTION ENGINE

(75) Inventors: Christof Knollmayr, Graz (AT); Andreas Zurk, Weinburg (AT); Kurt Prevedel, Graz (AT); Josef Wolkerstorfer, Graz (AT); Paul Kapus, Judenburg (AT)

(73) Assignee: AVL List GmbH, Graz (AT)

( * ) Notice: Subject to any disclaimer, the term of this patent is extended or adjusted under 35 U.S.C. 154(b) by 808 days.

(21) Appl. No.: 11/989,000

(22) PCT Filed: Jul. 4, 2006

(86) PCT No.: PCT/AT2006/000285

§ 371 (c)(1),
(2), (4) Date: Jan. 5, 2009

(87) PCT Pub. No.: WO2007/009139

PCT Pub. Date: Jan. 25, 2007

(65) Prior Publication Data

US 2009/0133390 A1 May 28, 2009

(30) Foreign Application Priority Data

| | | |
|---|---|---|
| Jul. 19, 2005 | (AT) | A 1216/2005 |
| Dec. 6, 2005 | (AT) | A 1953/2005 |
| Apr. 20, 2006 | (AT) | A 670/2006 |
| Apr. 26, 2006 | (AT) | A 707/2006 |

(51) Int. Cl.
*F01N 3/02* (2006.01)

(52) U.S. Cl.
USPC ..... 60/321; 60/320; 60/323; 123/41.28; 123/41.29; 165/42

(58) Field of Classification Search
USPC ..... 60/320–324; 123/41.82, 41.29, 41.31; 165/43
See application file for complete search history.

(56) References Cited

U.S. PATENT DOCUMENTS 3,086,839 A 4/1963 Bloch
3,357,413 A * 12/1967 Quinton ..... 123/41.05

(Continued)

FOREIGN PATENT DOCUMENTS

DE 3629945 10/1987
DE 9201320 5/1992

(Continued)

OTHER PUBLICATIONS

English Abstract of DE3629945.

(Continued)

*Primary Examiner* — Thomas Denion
*Assistant Examiner* — Jesse Bogue
(74) *Attorney, Agent, or Firm* — Dykema Gossett PLLC

(57) ABSTRACT

An exhaust gas line (1) of an internal combustion engine includes at least one catalytic converter (2) which is provided with at least one catalytic converter support (4) which is arranged in the housing (3) and which includes at least one first and one second area (5, 6) which can be flowed through in parallel, with the flow being capable of being deactivated in at least one area by a switching device (8) arranged in the exhaust gas line (1). In order to achieve a rapid activation of the catalytic converter in the simplest possible and most compact way, the areas (5, 6) of the catalytic converter support (4) have different physical and/or chemical properties in relation to response behavior, permeability, catalytic activity and/or thermal inertia.

3 Claims, 7 Drawing Sheets

(56) References Cited

U.S. PATENT DOCUMENTS

| | | | | | |
|---|---|---|---|---|---|
| 4,069,672 | A | * | 1/1978 | Milling | 60/618 |
| 4,312,304 | A | * | 1/1982 | Tyner | 123/41.74 |
| 4,513,698 | A | * | 4/1985 | Senga et al. | 123/184.36 |
| 4,896,830 | A | * | 1/1990 | Takamatsu | 237/12.1 |
| 4,953,525 | A | * | 9/1990 | Sakurai et al. | 123/41.28 |
| 4,991,546 | A | * | 2/1991 | Yoshimura | 123/41.31 |
| 5,129,473 | A | * | 7/1992 | Boyer | 180/68.1 |
| 5,131,229 | A | | 7/1992 | Kriegler et al. | |
| 5,251,577 | A | * | 10/1993 | Kojima | 123/41.74 |
| 5,589,143 | A | | 12/1996 | Mori et al. | |
| 5,724,931 | A | * | 3/1998 | Hollis | 123/142.5 R |
| 5,873,330 | A | * | 2/1999 | Takahashi et al. | 123/41.31 |
| 6,082,311 | A | | 7/2000 | Collin | |
| 6,151,892 | A | | 11/2000 | Brewer | |
| 6,347,969 | B1 | * | 2/2002 | Takahashi | 440/88 R |
| 6,357,227 | B1 | | 3/2002 | Neufert | |
| 6,471,559 | B2 | * | 10/2002 | Kashima | 440/88 G |
| 6,565,399 | B2 | * | 5/2003 | Nakase et al. | 440/89 H |
| 6,832,475 | B2 | * | 12/2004 | Tanaka et al. | 60/298 |
| 2004/0005250 | A1 | | 1/2004 | Fischer et al. | |
| 2005/0087154 | A1 | | 4/2005 | Hayman et al. | |
| 2005/0199381 | A1 | * | 9/2005 | Mercz et al. | 165/172 |
| 2006/0096555 | A1 | * | 5/2006 | Buck | 123/41.28 |
| 2006/0096568 | A1 | * | 5/2006 | Buck | 123/197.4 |
| 2007/0056276 | A1 | * | 3/2007 | Petutsching et al. | 60/321 |
| 2012/0144810 | A1 | * | 6/2012 | Lee | 60/298 |

FOREIGN PATENT DOCUMENTS

| | | | |
|---|---|---|---|
| DE | 19938038 | | 5/2000 |
| DE | 10201042 | | 8/2003 |
| WO | WO-2004111400 | * | 12/2004 |

OTHER PUBLICATIONS

English Abstract of DE10201042.
English Abstract of DE19938038.

* cited by examiner

EXHAUST GAS LINE OF AN INTERNAL COMBUSTION ENGINE

BACKGROUND OF THE INVENTION

1. Field of the Invention

The invention relates to an exhaust gas line of an internal combustion engine which includes at least one catalytic converter that is provided with at least one support for the converter arranged in a housing and which includes at least one first and one second area which can be flowed through in parallel, with the flow being capable of being deactivated in at least one area by means of a switching device arranged in the exhaust gas line.

The invention further relates to an internal combustion engine with an exhaust gas system and at least one water injection device for injecting water into the exhaust gas line.

The invention further relates to a cylinder head for an internal combustion engine with liquid cooling and including a liquid-cooled exhaust manifold which is arranged integrally with the cylinder head, with the cylinder head includes at least one first cooling chamber.

2. The Prior Art

An exhaust gas line with a catalytic converter with supports for the catalytic converter is known from DE 36 29 945 A1, with the supports being arranged concentrically with respect to each other and both can be flowed through parallel with respect to each other. The exhaust gas flow is divided into two exhaust gas ports downstream of the supports for the catalytic converters. By a switching device arranged in an exhaust port one of the two supports can be deactivated. A mutual influence of temperature of the supports for the catalytic converter can thus be achieved, so that the temperature range which is most beneficial for the aftertreatment of the exhaust gases can be reached more quickly or can be held in a more secure manner.

DE 102 01 042 A1 discloses an exhaust system for an internal combustion engine with a catalytic exhaust gas converter, comprising a housing, a support for the converter held in the housing and an intake manifold. A swirl generator is arranged in the intake manifold which leaves open a central flow path. The support for the converter comprises an inside area and an outside area, when seen in the axial direction, with the cell density of the flow conduits in the inside area being larger than in the outside area and/or the inside area is arranged with a higher catalyst activity than the outside area. An active changeover possibility is not provided between the two areas.

DE 199 38 038 A1 describes an exhaust gas treatment apparatus with varying cell density, with the densities of the cell groups being arranged in such a way that an even flow through the entire substrate is promoted.

DE 92 01 320 U1 further discloses a catalytic converter apparatus for internal combustion engines in which at least two exhaust gas intake manifolds and at least two gas outlet manifolds are connected to the housing enclosing the catalytic converter substrate whose cross-sectional surface areas on the inlet and outlet side are each opposite to different areas of the associated face surfaces of the substrate. A variation depending on the operation of the exhaust flow guidance through the catalyst substrate can be performed with and without several flow deflections via shut-off devices arranged on the intake and outlet side. A sufficient exhaust-gas-cleaning effect shall thus be achieved under the highest number of possible operating conditions of the internal combustion engine. Areas with different physical and/or chemical properties concerning the response behavior, the permeability, the catalytic activity and/or thermal inertia are not provided.

The dimensioning of the cross section and the permeability of the catalytic converter represents a compromise between a surface sufficiently loaded with noble metal for ensuring a rapid light-off during cold starting and low pressure loss at nominal power. The former occurs in the case of highly effective catalytic coatings at a given space and high cell densities; the latter profits in contrast from low cell densities.

This target conflict is solved in the state of the art for example by switching behind one another a first catalytic converter support with a high cell density and short length and a second catalytic converter support with a rather low cell density but with a larger length and larger diameter which can be separate in the exhaust line or can also be combined in a housing. A further embodiment which comes with a stronger compromise in comparison with the first embodiment uses a single catalytic converter support which is provided on its gas intake side on a certain length with a especially highly effective catalytic coating, but is provided on its remaining length with a comparatively normal coating, so that this is known as zone coating. Further embodiments which might surely be advantageous with respect to the function but would require a large amount of constructional work such as catalytic converter supports which are supplied in a cascading switchable manner are not used due to their complexity. Electrically heatable catalytic converter supports for rapid light-off, which for this reason could be arranged in a larger way and with lower pressure loss according to requirements at nominal power, require metal as a support material and a respective electric supply and are currently hardly used due to high costs.

Future spark-ignition engine concepts which allow us to expect a special doubling of currently common specific output through multi-stage turbo charging with respectively extreme spreads of lowest and maximum exhaust volume flows and moreover require low exhaust gas counter-pressures under full load and nominal power will be difficult to operate with the known simple constructional solutions. Complex constructional solutions such as cascade arrangements will soon meet limits through available space. Moreover, the heating-up behavior will be additionally impaired by a rising amount of wall surfaces significantly additionally in contact with exhaust gases through multi-stage turbo charging concepts.

The adherence to component temperature limits in the catalytic converter and/or turbocharger is currently ensured by using the evaporation heat of additionally injected fuel. As a result, a rich mixture is present in a considerable part of the operating characteristics, which is primarily responsible for the clearly marked difference between cycle consumption and practical consumption as compared to diesel engines. This problem increases with rising specific output and presents a target conflict for highly charged down-sizing engine concepts whose purpose was to reduce consumption in real vehicle operations.

Especially turboengines can be operated with a stoichiometric mixture even under full load and nominal output in a manner allowing an exceptionally low consumption with consumption improvements at nominal output of between 15% and 30%, and absolute values around approximately 260 g/kWh when other measures such as enrichment are used for cooling purposes. In real driving operations, the savings can be in a magnitude of 5% to 20%, depending on driving profile, combination of engine and vehicle, and fuel quality.

Two approaches are currently known in order to achieve the improvement in consumption:

1) Use of materials resistant to high temperatures for exhaust manifold, turbine and catalytic converter in order to reduce the need for enrichment by shifting currently typical turbine intake temperatures of 950° C. to 1000° C. to 1050° C. In addition to significantly higher costs and increasing problems with the catalytic converter supports for example, thermomechanical problems and heat radiation, the potential is limited in this case. Especially when operations are conducted with unfavorably hot ambient conditions and cheaper fuels with lower octane numbers, the temperature threshold again needs to be maintained by increased enrichment.
2) A higher potential than an increase in the temperature limit is the inclusion of the exhaust-conducting pipes before the turbine in a water-cooled cylinder head for example, as was described in the Austrian patent application A 1216/2005 for example. Gas cooling is not carried out directly in this case, but indirectly by heat transfer at the outside surfaces. By providing a respective configuration, a broader effective range can be ensured than with raising the temperature limit and the need for additional enrichment is potentially lower. A relatively low production effort can be achieved by high system integration. The heat is discharged through the cooling water circulation however and at speeds beneath maximum torque one must take a certain loss of torque in turboengines into account because a minimum flow through the water jacket and thus a cooling for limiting boiling of the water must be maintained, thus leading to a lower energy content of the exhaust gas.

It is known from WO 98/10185 A1 to inject water for $NO_x$ reduction before a turbocharger into an intake system of an internal combustion engine. A similar system is known from JP 56-083516 A.

U.S. Pat. No. 5,131,229 A discloses a turbo internal combustion engine with external exhaust gas recirculation, with water being injected into the exhaust gas stream for $NO_x$ reduction. The water is taken from a tank which is heatable for protection against freezing.

U.S. Pat. No. 6,151,892 A1 discloses an internal combustion engine with programmed water injection into the exhaust gas system in order to change gas dynamics for improved adjustment to cylinder scavenging. As a result, the oscillation length is influenced by changing the exhaust gas temperature.

An exhaust gas system for an internal combustion engine is further known from U.S. Pat. No. 6,357,227 B1, with a condensation water collector being provided which is provided upstream of a device for cleaning the exhaust gas and is connected with the exhaust gas line in respect of flow. The condensation water collector is connected with a water reservoir which is connected in respect of flow with a reservoir for a reducing agent for a catalytic converter. The water which is guided in the exhaust gas line can condensate before entering the exhaust gas aftertreatment device. The disadvantageous aspect is that water is taken from the untreated exhaust gases upstream of the exhaust gas aftertreatment device for the condensation device, as a result of which the condensation system is subjected to high contamination. A permanent function of this system is therefore not ensured.

It is known from US 2005/0087154 A1 to arrange the exhaust port integrally with the cylinder head. The main cooling chamber formed by an upper and a lower partial cooling chamber is thermally connected with the exhaust port. A separate control of the cooling of the exhaust port is not provided.

It is the object of the present invention to solve this target conflict with comparatively little additional effort and to enable optimal exhaust gas cleaning in nearly every operating range of the engine.

It is also the object of the invention to considerably reduce fuel consumption.

It is a further object of the invention to enable setting the cooling of the exhaust manifold, independent of the cooling chamber of the cylinder head.

SUMMARY OF THE INVENTION

This is achieved in accordance with the invention in that the areas of the catalytic converter support have different physical and/or chemical properties in relation to response behavior, permeability, catalytic activity and/or thermal inertia. It can be provided that the two areas have different cell densities and/or that the areas have different coatings.

The two areas can be arranged coaxially with respect to each other or next to one another when seen in the longitudinal direction.

The cross-sectional surface areas of the two areas are different. The larger area is dimensioned in a sufficiently large manner for nominal output needs, whereas the area with the small cross-sectional surface area is reserved for cold starting.

The catalytic converter support is preferably arranged in an integral way and consists of a single monolith.

The switching device can be formed by a simple switching flap. It is also possible however that the switching device is part of the waste gate of an exhaust gas turbocharger arranged in the exhaust gas line.

It is principally possible to arrange the switching device downstream or upstream of the catalytic converter support in the exhaust gas line.

A separating wall is arranged between the switching device and the catalytic converter support alongside the exhaust gas flow, which separating wall allows for a flow divided according to the areas between the catalytic converter support and the switching device.

In order to compensate for high temperature gradients between the two areas, it is advantageous when in the area of the switching device and/or in the area of the separating wall at least one leakage opening is arranged which measures a predetermined quantity of exhaust gas to the deactivated area. It can be provided that the leakage opening is formed by at least one breakthrough, an undulating portion or a perforation of the separating wall, preferably in a wall region adjacent to the catalytic converter support.

It is provided in an especially preferred embodiment of the invention that a first flow deflection device is arranged in the area of the outlet from the second area of the catalytic converter support, which deflection device recirculates at least a portion of the exhaust gas exiting from the second area through a first sector of the first area, so that the exhaust gas flows in a meandering manner through the exhaust gas catalytic converter. The first area of the catalytic converter support is thus also brought to starting temperature. This leads to a substantial utilization of the residual heat or the heat liberation of starting reactions, which also contributes to bringing the catalytic converter rapidly to operating temperature.

When seen in the longitudinal direction, the areas and/or sectors can be arranged next to one another, but it is also possible to provide a coaxial arrangement with respect to each other.

The cross-sectional surface areas of the areas and/or the sectors can be different. The larger area is dimensioned in a sufficiently large manner for nominal output needs. The area with the smaller cross-sectional surface area is reserved for cold starting.

It is preferably provided that a second flow deflection device for the exhaust gas exiting from the first sector of the first area from the catalytic converter support is arranged in the area of the intake of the first area of the catalytic converter support, which second deflection device supplies the recirculated exhaust to a second sector of the first area. As a result of the deflecting devices, the exhaust gas can be guided in a meandering manner through the catalytic converter support during the heat-up phase, thus enabling a rapid heat-up of the exhaust gas catalytic converter to response temperature.

It is especially advantageous when the first flow deflection device is formed by a first switching device which can be switched over between at least two positions, with the exhaust gas exiting from the second area of the catalytic converter support being capable of being recirculated in the direction of the first sector of the first area in a first position. It is preferably provided that a first separating wall is arranged between the catalytic converter support and the first switching device, which separating wall is aligned substantially in the longitudinal direction of the flow, with one end of the separating wall being arranged downstream of the first area, thus defining the boundary between first and second sector of the first area.

It can further be provided that the second flow deflection device is formed by a second switching device which can be switched at least between two positions, with the exhaust gas recirculated through the first sector of the first area being deflectable in the direction of a second sector of the first area in a first position, with a separating wall which is aligned in the longitudinal direction of the flow preferably being arranged between the second switching device and the catalytic converter support, which separating wall divides the exhaust gas flow into a first flow path to the first area and a second flow path leading to the second area when the second switching device is opened.

The flow cross section of the second sector of the first area of the catalytic converter support corresponds at least to the flow cross section of the first sector of the first area of the catalytic converter support.

It is provided in a simple embodiment of the invention that the first and/or second switching device is formed by a switching flap. It is also possible that at least one switching device is functionally a part of a waste gate of an exhaust gas turbocharger arranged in the exhaust gas line. It is especially advantageous when the first and second switching device can be actuated simultaneously through at least one actuator.

In order to reduce fuel consumption it is provided that the water injection device opens upstream of an exhaust gas aftertreatment device, preferably upstream of a turbine of an exhaust gas turbocharger, into the exhaust gas line. The need for an enrichment of the mixture can be avoided to a substantial extent by air-distributed injection and evaporation of water or hydrous solutions into the exhaust gas line.

The water can be obtained from direct filling, by condensation of engine exhaust gases (approximately 1 kg water per kg of combusted fuel) in a suitable condensation system and by use of condensate from vehicle systems such as the air-conditioning system. In order to collect small quantities of condensate that are obtained continually and in order to keep the heat exchange surfaces required for condensation as small as possible, a reservoir is provided whose size is dimensioned according to operational experience in such a way that complete emptying is avoided. Since the water has approximately five times the heat of evaporation of fuel, the volumetric need for water or condensate for exhaust gas cooling is relatively low. The reduction in average fuel consumption by avoiding the enrichment of the mixture can be in a magnitude of 5% to 20% depending on driving profile, combination of engine and vehicle and fuel quality. Approximately 5 liters of fuel can be saved for each liter of consumed water for example.

It can be provided that the condensation system comprises an exhaust gas condensation apparatus which can be connected with the exhaust gas line via an exhaust gas withdrawal line. It is possible in an alternative way or in addition thereto that the condensation system comprises an air condensation device, with the air condensation system preferably being part of an air-conditioning system.

An advantageous embodiment of the invention provides that the condensation system comprises a condenser with filter and reservoir into which opens the condensate feed of the exhaust gas condensation device and/or the condensation feed of an air condensation device, preferably an air-conditioning system, with the water injection system preferably comprising a quantity regulation device which is arranged in the water injection system downstream of a feed pump.

The service life of the condensation system can be increased substantially when the exhaust gas withdrawal line branches from the exhaust gas line downstream of the exhaust gas aftertreatment device. In order to ensure secure operation in winter, it is advantageous when the water injection system either comprises a frost protection device or is arranged in such a way that the correct function will become available again with increasing heating of the engine. A frost-induced failure of the function can be detected by the engine control system, with the known enrichment of mixture being used when required for maintaining the limit temperatures until the system is functional again. The same also applies in the case of an insufficient supply of condensate after a long period of non-operation of the vehicle.

The exhaust gas removed via the exhaust gas withdrawal line is supplied to an intake line of the internal combustion engine after passing the exhaust gas condensation device via an exhaust gas recirculation line connected to the condensation system. A non-return valve or a control valve can be arranged in the exhaust gas recirculation line. In order to enable a recirculation of water from the exhaust gas by recirculating exhaust gas to the intake line in charged part-load operation, it is advantageous when the exhaust gas recirculation line opens into the intake line upstream of a turbocharger.

In order to enable setting the cooling of the exhaust manifold independent from the cooling chamber of the cylinder head it is advantageous when the area of the exhaust gas manifold is enclosed at least partly by a second cooling chamber which is separated at least partly from the first cooling chamber, with the cooling agent flow through the second cooling chamber being adjusted to be separated from the cooling agent flow through the first cooling chamber. A separate cooling agent inlet which preferably starts out from the cylinder head sealing surface and which is flow-connectable with a cooling jacket of the cylinder block opens into the second cooling chamber.

The water inlet into the second cooling chamber can occur as a separate water inlet from the outside or via openings in the fire deck. In the latter configuration, throttle openings in the cylinder head gasket can allow for an additional adjustment of the cooling agent quantity and the even distribution. The cooling agent inlet or cooling agent outlet of the additional second cooling chamber may comprise a thermostat or a preferably electric switching valve for controlling the additional water circulation in the engine heat-up phase.

The invention will now explained in greater detail by reference to the attached schematic drawings.

DETAILED DESCRIPTION OF THE PREFERRED EMBODIMENTS

Figure 1:
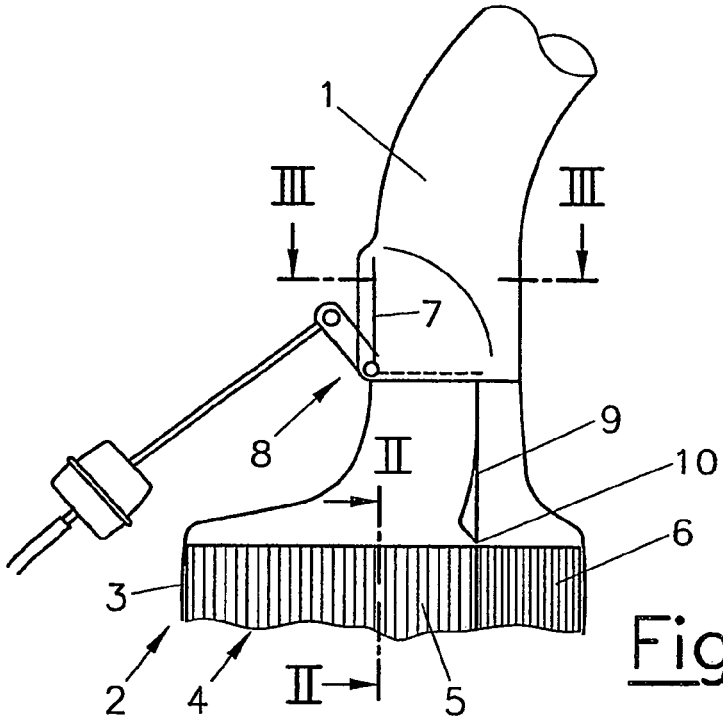
FIG. 1 shows a part of an exhaust gas line in accordance with the invention in a longitudinal sectional view.
Figure 2:
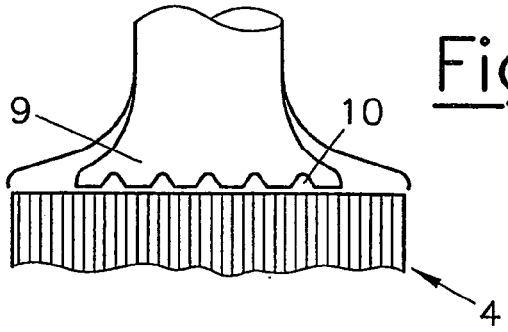
FIG. 2 shows the exhaust gas line in a sectional view along line II-II in FIG. 1.
Figure 3:
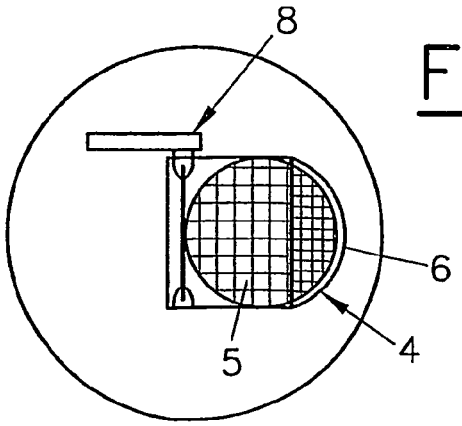
FIG. 3 shows the exhaust gas line in a sectional view along line III-III in FIG. 1.
Figure 4:
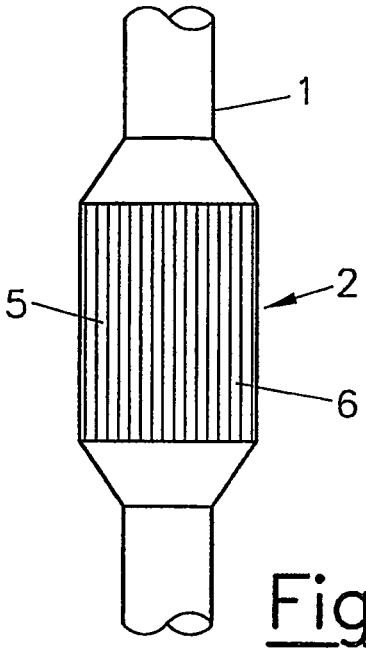
FIG. 4 shows a catalytic converter in a longitudinal sectional view.

A catalytic converter 2 is arranged in an exhaust gas line 1, comprising a catalytic converter support 4 which is formed by a monolith and which has a first area 5 and a second area 6 with different properties concerning the response behavior, the permeability, catalytic activity or the like. The different properties are caused by different cell densities and/or different coatings of the catalytic converter support 4 in the two areas 5, 6. Close to the inlet area or outlet area into the catalytic converter support 4, a switching device 8 which is formed by a flap 7 is arranged in the exhaust gas line 1. A separating wall 9 formed by a plate is aligned in the direction of the exhaust gas flow between the switching device 8 and the catalytic converter support 4, which separating wall divides the exhaust gas flow into two flow paths according to the areas 5, 6 between the catalytic converter support 4 and the switching device 8.

For removing high temperature gradients of the two areas 5, 6, the separating wall 9 comprises leakage openings 10 which allow a minimum flow through the deactivated area 5 when flap 7 is closed. The minimum flow can be provided by breakthroughs, undulating portions, perforations or the like in the separating wall 9.

Figure 5:
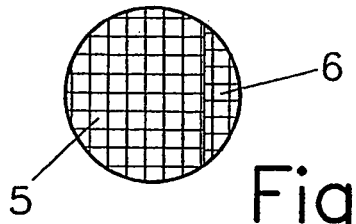
FIG. 5 shows a catalytic converter in a cross-sectional view in a first embodiment.
Figure 6:
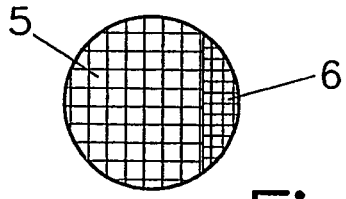
FIG. 6 shows a catalytic converter in a cross-sectional view in a second embodiment.
Figure 7:
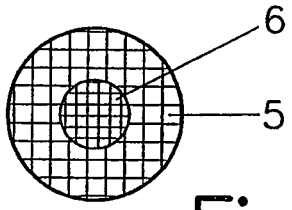
FIG. 7 shows a catalytic converter in a cross-sectional view in a third embodiment.
Figure 8:
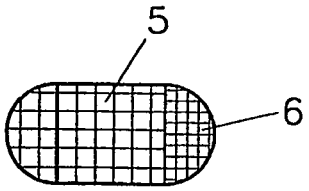
FIG. 8 shows a catalytic converter in a cross-sectional view in a fourth embodiment.
Figure 9:
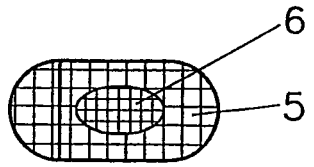
FIG. 9 shows a catalytic converter in a cross-sectional view in a fifth embodiment.
Figure 10:
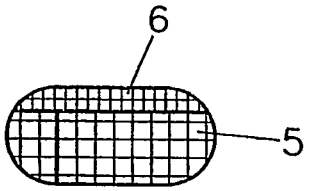
FIG. 10 shows a catalytic converter in a cross-sectional view in a sixth embodiment.

FIGS. 4 to 10 show different possibilities for constructional arrangement of the two areas 5, 6. In FIG. 5, the areas 5, 6 have the same cell density but different coatings. In the remaining FIGS. 6 to 10, the areas 5, 6 are provided with different cell densities. In addition to a circular cross-sectional shape, an oval form is also possible, as is shown in FIGS. 9 to 10. The smaller area 6 can be arranged to the side in the area of an outside wall or concentrically relative to the larger area 5.

Flap 7 is closed during cold starting. After the so-called light-off, flap 7 is increasingly opened by the engine controls in order to enable maintaining the catalytic reaction during the heating of the remaining large area 5 of the monolith. After the activation of the entire catalyst 2, flap 7 is pivoted completely out of the exhaust gas flow. In the case of applications with extremely large spreads of the exhaust gas volume flow in operation, the extinguishing of the catalytic converter 2 during idle operation for example can be prevented by maintaining the closure of flap 7. Flap 7 can also be attached in a comparable form also on the outlet nozzle. In order to avoid large dimensions that are difficult to manage, thermal loads and actuating forces of the flap 7, it is arranged in an area of a relatively small diameter, i.e. at the beginning of the intake housing or at the end of the outlet housing, with the separating wall 9 ensuring the guidance of the gas directly up to the entrance into the areas 5, 6 of the catalytic converter support 4. Influence on the approach of the flow against the catalytic carrier support can further be made by the arrangement of the separating wall 9.

Area 6 can be provided over its length with an especially highly effective catalytic coating for rapid light-off. In contrast to known coatings, the zone coating of the catalytic converter support 4 does not occur along its flow axis, but in the radial direction parallel to the flow axis, according to the intended dimension of the segment of the circle or other surface section intended for application by flap 7 for cold running.

Furthermore, the ceramic substrate of the catalytic converter support 4 can be provided in the area 6 of the monolith with higher cell density according to production by extrusion process in order to obtain advantageously large active surfaces at low thermal inertia. This measure can also be made in combination with the previously described zone coating.

Figure 11:
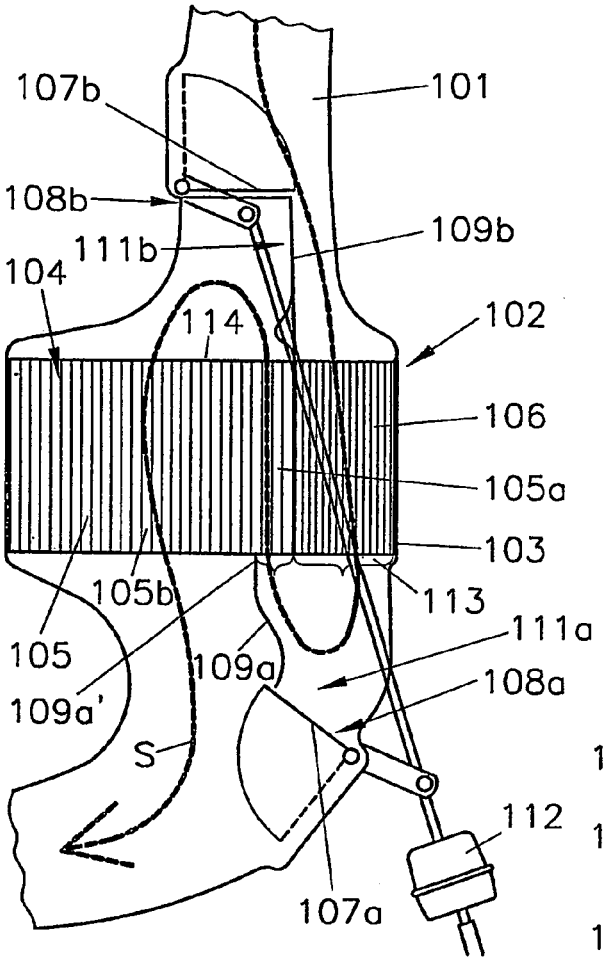
FIG. 11 shows a part of an exhaust gas line in accordance with the invention in a further embodiment in a longitudinal sectional view during a heat-up phase.
Figure 12:
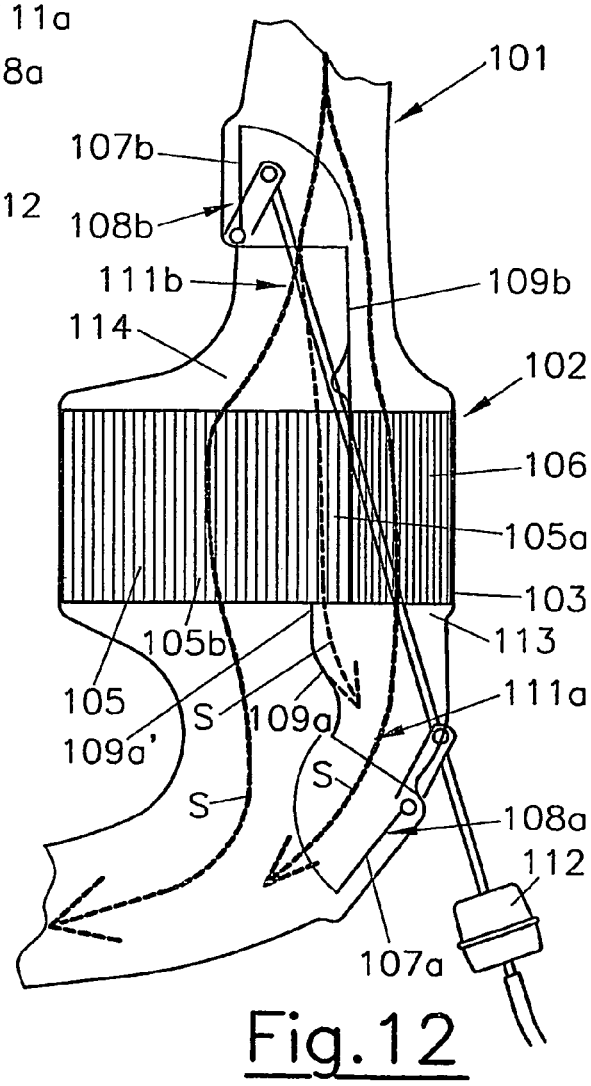
FIG. 12 shows the same part in the operational hot state.

FIGS. 11 and 12 show an exhaust gas line 101 which comprises a catalytic converter 102 with a catalytic converter support 104 which is arranged in a housing 103, is formed by a monolith and has a first area 105 and a second area 106 with different properties, when required, concerning the response behavior, permeability, catalytic activity or the like. The different properties are caused by different cell densities and/or different coatings of the catalytic converter support 104 in the areas 105, 106. Switching devices 108*a*, 108*b* are arranged close to the intake area and the outlet area into and from the catalytic converter support 104 in the exhaust gas line 101, which switching devices are formed by flaps 107*a*, 107*b*. A first separating wall 109*a* is aligned in the direction of the exhaust gas flow between the first switching device and the catalytic converter support 104, which wall is formed by a plate for example. A second separating wall 109*b* is also provided between the second switching device 108*b* and the catalytic converter support 104, which separating wall is arranged substantially along the exhaust gas flow S. When the second flap 107*b* is opened, the second separating wall 109*b* divides the exhaust gas flow into two flow paths according to the areas 105, 106. The first switching device 108*a* forms a first deflection device 111*a* together with the first separating wall 109*a* for exhaust gas exiting from the second area 106 of the catalytic converter support 104. The end 109*a*' of the first separating wall 109*a* is arranged in the area of the outlet of the first area 105, so that the exhaust gas flow which is deflected according to the arrow S is recirculated into a first sector 105*a* of the first area 105. Through a respective choice of the arrangement of end 109*a*' of the first separating wall 109*a*, the ratio of the flow cross sections of the first sector 105*a* to the second sector 105*b* can be determined, with the flow cross section of the second sector 105*b* being larger or equal to the flow cross section of the first sector 105*a*. After flowing through the first sector 105*a* of the first area 105, the recirculated exhaust gas is deflected again by the second deflection device 111*b* which is formed by the second switching device 108*b* and the second separating wall 109*b* and is supplied to a second sector 105*b* of the first area 105 of the catalytic converter support 104, so that the exhaust gas flows through the catalytic converter support 104 in a meandering manner in three courses. The switching devices 108*a*, 108*b* can be opened and closed synchronously via an actuating device 112.

The areas 105, 106 can have different constructional shapes and/or coatings. It is possible that the areas 105, 106 are provided with the same cell density but with different coatings. It is similarly possible to provide the areas 105, 106 with different cell densities. In addition to a circular cross-sectional shape it is also possible to have an oval form. The smaller area 106 can be arranged laterally in the area of an outside wall of the housing 103 or even concentrically to the larger area 105.

The flaps 107*a*, 107*b* are closed during cold starting, as shown in FIG. 11. The exhaust gas flows through the second area 105 according to arrow S in FIG. 11, is deflected by deflection device 111*a* and recirculated through a first sector 105*a* of the first area 105 of the catalytic converter support 104. The exhaust gas is thereafter deflected again by the second deflection device 111*b* and flows through the second sector 105*b* of the first area 105. As a result of this meandering flow through the catalytic converter support 104, an especially rapid heating of the catalytic converter 102 is achieved which occurs in an even manner over the cross section. After the activation of the entire catalytic converter 102, the flaps 107*a*, 107*b* are swiveled completely out of the exhaust gas flow, as is shown in FIG. 12.

In this case too, the area 106 can be provided with an especially highly effective catalytic coating over its length for the purpose of a rapid light-off. In contrast to known coatings, the zone coating of the catalytic converter support does not occur along its flow axis, but in the radial direction parallel to the flow axis, according to the intended size of the circular segment or other surface section provided for supply by flaps 107*a*, 107*b* for cold running.

Furthermore, the ceramic substrate of the catalytic converter support 104 can be provided in the area 106 of the monolith with a higher cell density according to production in extrusion process in order to achieve advantageously large active areas at low thermal inertia. This measure can also be made in combination with the zone coating as described above.

Figure 13:
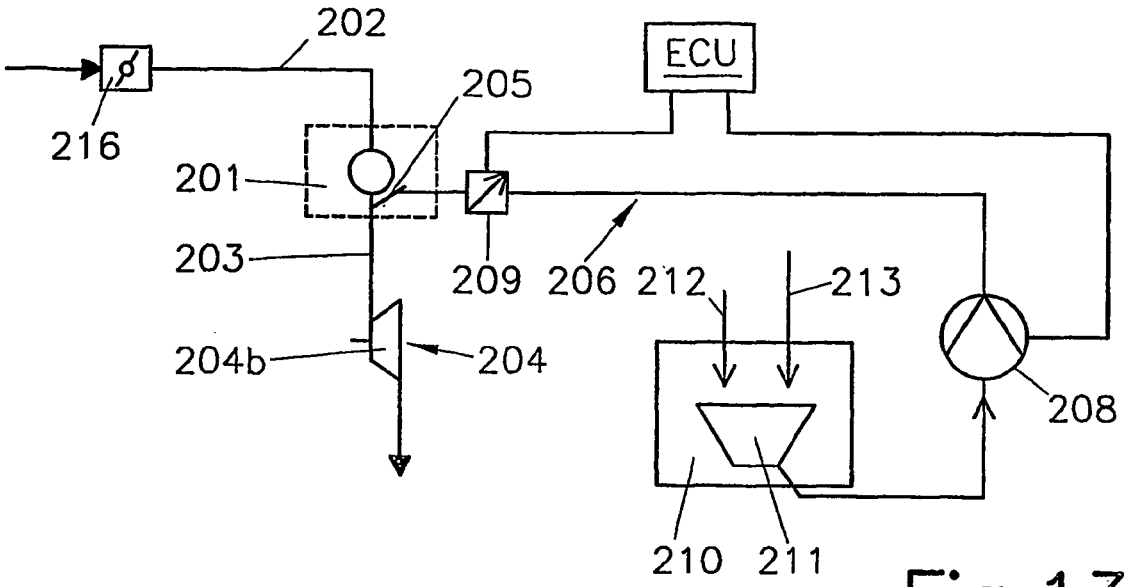
FIG. 13 shows an internal combustion engine in accordance with the invention in a first embodiment.

FIG. 13 shows an internal combustion engine 201 with in intake line 202 and an exhaust line 203. A turbine of a turbocharger 204 is designed with reference numeral 204*b*, which turbine is arranged in the exhaust line 203. Water can be injected into the exhaust line 203 via a water injection device 205 upstream of the turbine 204*b* and upstream of an exhaust gas aftertreatment device 207. The water injection system 206 further comprises a feed pump 208 and quantity control device 209 for dosing the water quantity. The feed pump 208 and the quantity control device 209 are controlled by a control unit ECU. The injection preferably occurs into the exhaust ports of the internal combustion engine 201, directly after the exhaust valves. The water injection device 205 is arranged in such a way that a substantially air-distributed injection of the water is ensured. This can occur either via nebulizer nozzles or via individual nebulizer valve units. The nozzles of the water injection device 205 need to be arranged in a cooled environment in such a way that no formation of vapor bubbles occurs within the nozzle and within the distribution lines.

The gaining of water on board of the vehicle can occur through a condensation system 210 with a condenser 210*a*, a filter (not shown) and a reservoir 211. The condensate feed line 212 of an exhaust gas condensation device and/or the condensate feed line 213 of an air condensation device such as an air-conditioning system opens into the reservoir 211 of the condensation system 210.

The injection of the water occurs against exhaust back-pressure, which is why injection pressures of approximately 2 bar to 5 bar are necessary.

Figure 14:
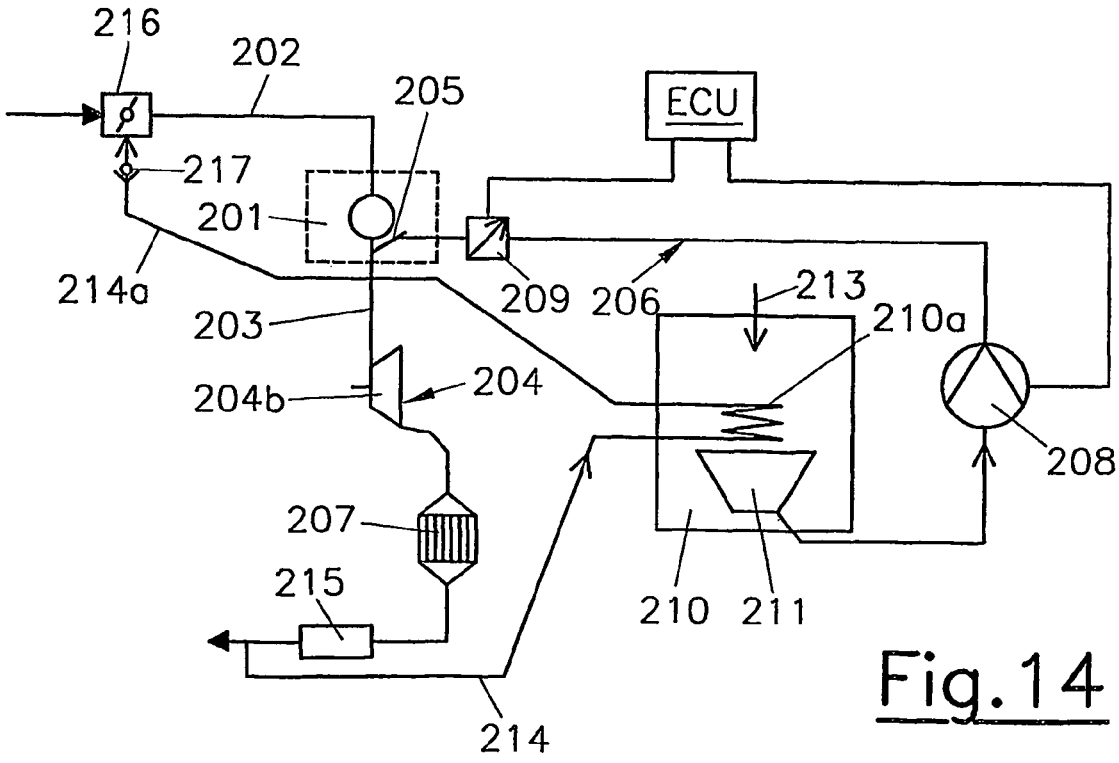
FIG. 14 shows an internal combustion engine in accordance with the invention in a second embodiment.

FIG. 14 shows an embodiment of a water-injection system 206 and a condensation system 210, with waste gas being taken via an exhaust gas withdrawal line 214 from the exhaust gas line 203 downstream of the exhaust gas aftertreatment device 207 which is formed by a catalyst for example and downstream of the muffler 215 and is supplied to the condensation system 210. A considerable reduction in the temperature already occurs because the exhaust gas is taken from the end of the exhaust gas line 203. Water is reclaimed in the condensation system 210 by condensation of the exhaust gas or the air by using the low temperatures of an air-conditioning system, which water is collected in a reservoir 211. The dry cooled gas is supplied downstream of the throttle valve 216 to the intake line 202 via an exhaust gas recirculation line 214*a*, in which a non-return valve 217 is arranged. Cooled recirculated exhaust gas is thus available in the intake line 202. The intake manifold pressures prevailing under partial load allow exhaust gas conveyance for condensation. The non-return valve 217 closes at a higher charge pressure. Exhaust gas recirculation and thus condensation are prevented. Exhaust gas condensation thus only occurs at throttled part-load operation, where actually low exhaust gas temperatures prevail which are beneficial for condensation and it is possible to make do with small condensation systems 210. In order to ensure sufficient supply in case of demand which exists exclusively during higher engine loads, the reservoir 211 is required which should contain at least the hourly requirement of condensate for an enrichment-free operation at nominal output. In addition to condensation from exhaust gas, condensate obtained from other vehicle systems such as especially the heat exchanger or air-conditioning system can be used and collected in the reservoir 211.

Figure 15:
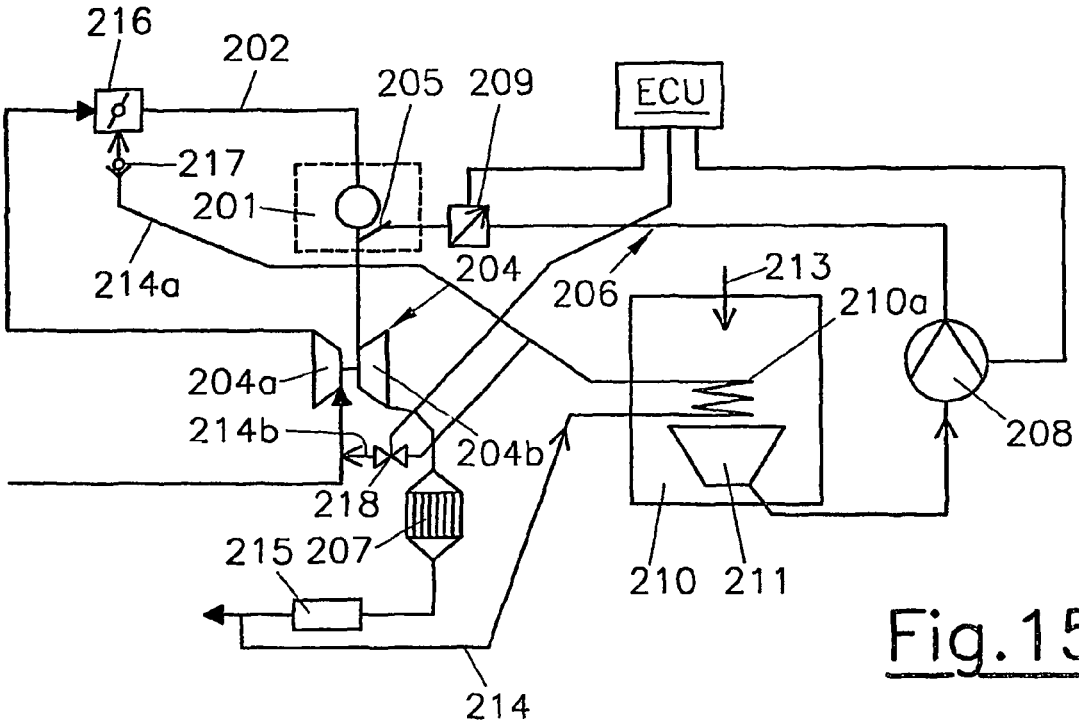
FIG. 15 shows an internal combustion engine in accordance with the invention in a third embodiment.

As is shown in FIG. 15, additional condensate quantities can be obtained from operations with clean, cooled and quantity-controlled recirculated exhaust gas even during charged partial loads, such that the exhaust gas is supplied via a control valve 218 controlled via the control unit ECU upstream of the compressor 204*a* of the turbocharger 204 to the intake line 202 via an exhaust gas recirculation line 214*b*. The operation of the condensation system 210 occurs through pressure difference between the entrance into the compressor 204*a* and the exhaust pressure downstream of the exhaust gas aftertreatment device 207 by interposing control valve 218.

In order to enable secure operations in winter, the water injection system 206 can be provided with a heatable configuration.

Figure 16:
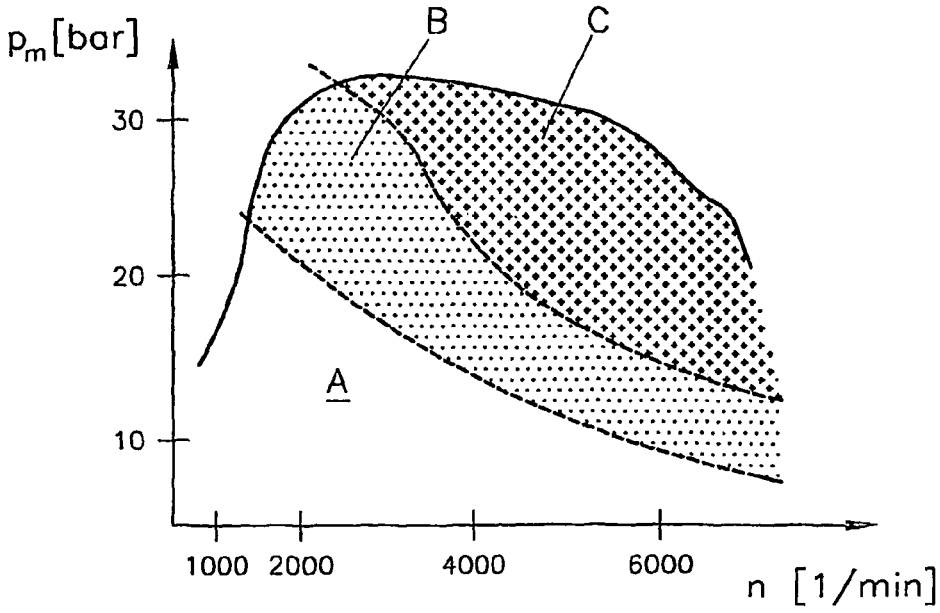
FIG. 16 shows a characteristic diagram of a spark-ignition engine.

FIG. 16 shows a characteristic map of a spark-ignition internal combustion engine, with the medium pressure $p_m$ being entered over the speed n. A indicates the lower part-load range, B the middle part-load range and C the upper part-load range. Considerable disadvantages concerning consumption occur especially in the middle and upper part-load ranges B, C as compared with stoichiometric operations, because in these operating ranges it is mandatory to provide enrichment for maintaining the exhaust gas temperature limits. Enrichment can be avoided in the ranges B, C by water injection and disadvantages in consumption can thus be avoided.

Figure 17:
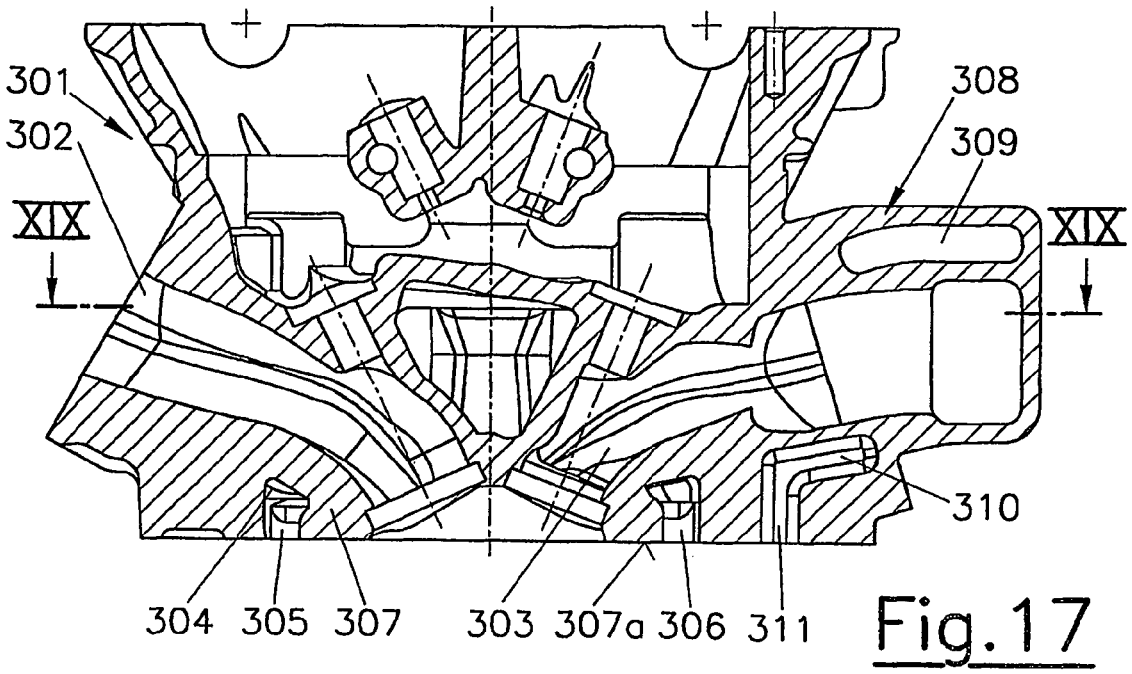
FIG. 17 shows a cylinder head in accordance with the invention in a sectional view along line XVII-XVII in FIG. 18.
Figure 18:
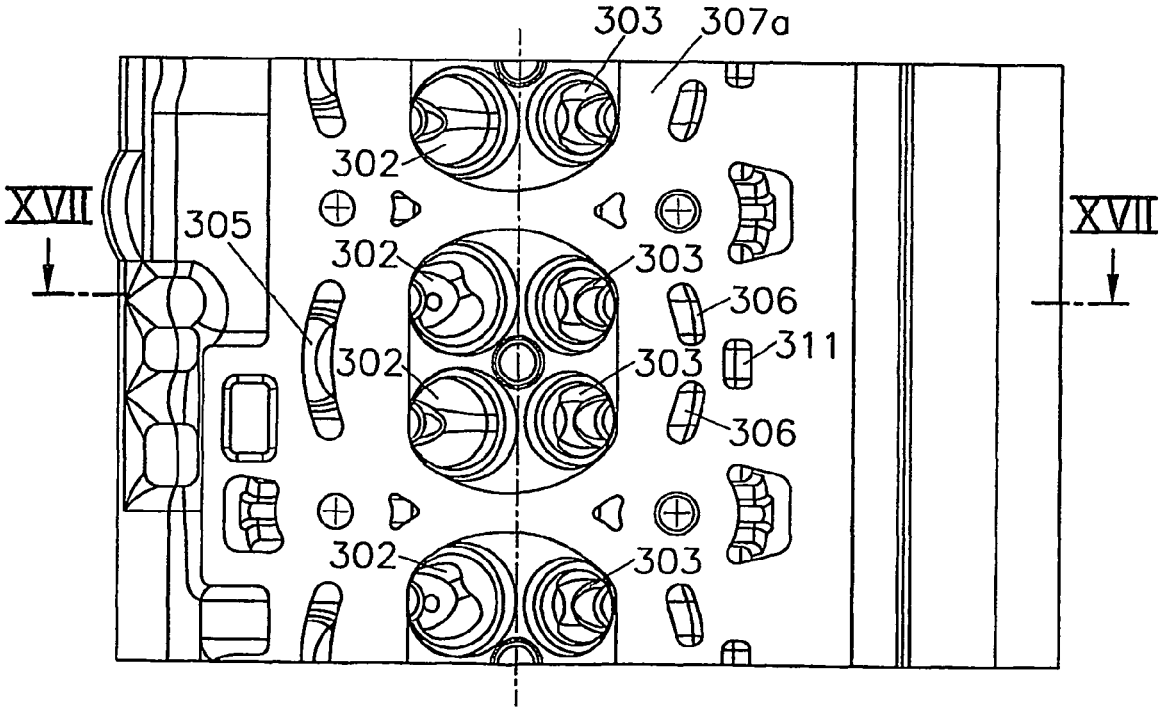
FIG. 18 shows the cylinder head in a view on the side of the fire deck.
Figure 19:
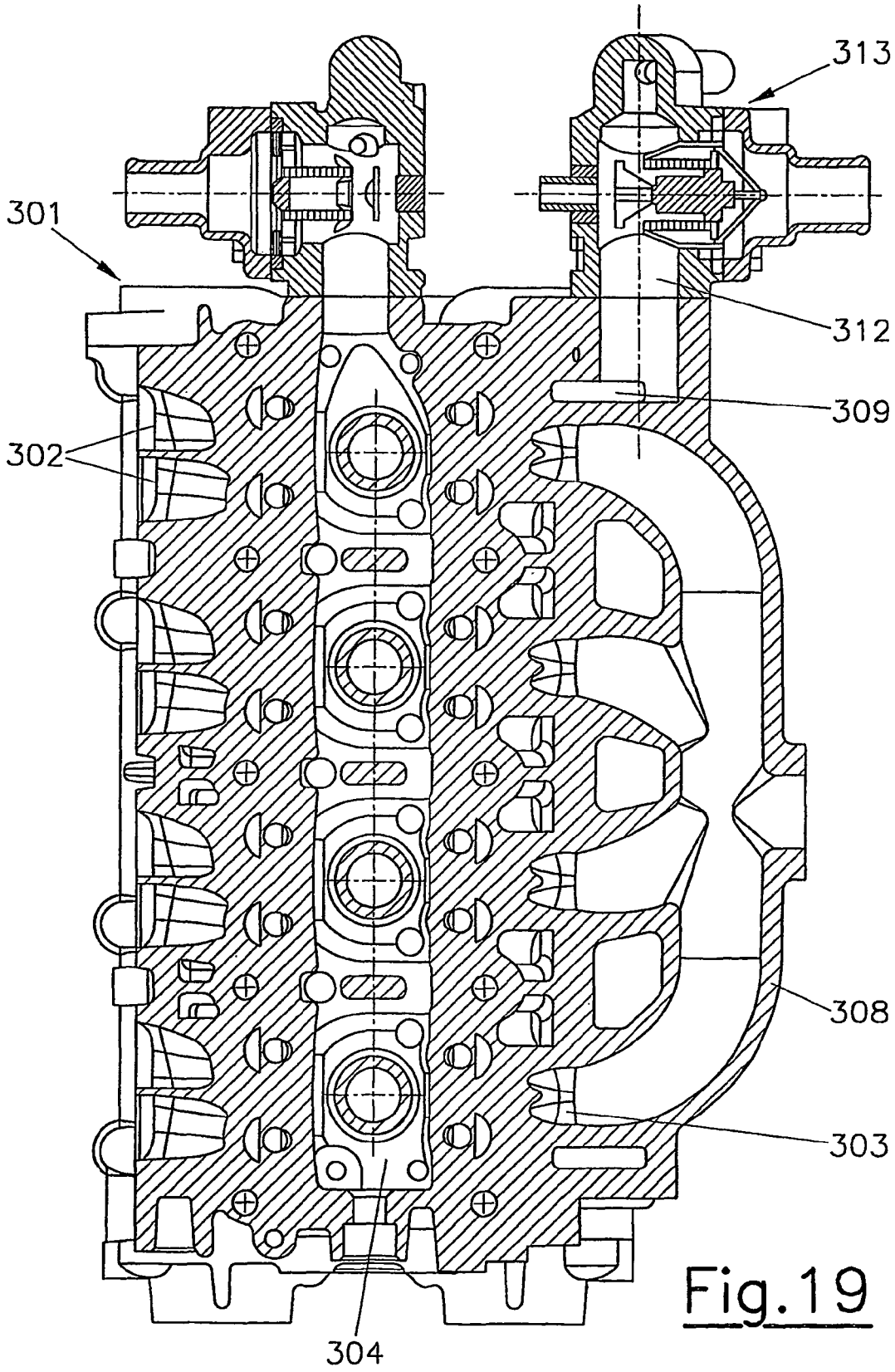
FIG. 19 shows the cylinder head in a sectional view along line XIX-XIX in FIG. 17.

FIGS. 17 and 18 show a cylinder head 301 for an internal combustion engine with two intake and two exhaust valves per cylinder. Reference numeral 302 indicates the intake ports and reference numeral 303 the exhaust ports. The cylinder head 301 comprises a cooling chamber 304 which forms the main cooling jacket for cooling thermally critical areas adjacent to the combustion chamber and which can be connected via first intake openings 305, 306 in the fire deck 307 with a cooling jacket of a cylinder block (not shown).

An exhaust manifold 308 is formed integrally in the cylinder head 301 which is enclosed at least partly by a second cooling chamber 309. The second cooling chamber 309 is substantially separated from the first cooling chamber 304 and has separate inlets 310 and outlets 312 for the coolant. In the embodiment shown in the Figs., the second cooling chamber 309 can be connected with the cooling jacket of the cylinder block via separate second inlet openings 311 in the cylinder head gasket surface 307*a* of the fire deck 307.

The demand for coolant and the heat discharge can be controlled for the area of the exhaust manifold 308 separate from the first cooling chamber 304 by the separate second cooling chamber 309. The water inlet 310 into the second cooling chamber 309 in the area of the exhaust manifold 308 can occur through separate water inlet openings from the outside or via the second inlet openings 311 in the fire deck 307. In the latter embodiment shown in FIGS. 17 and 18, the throttle openings can be provided in the cylinder head gasket (not shown in greater detail) in the area of the second inlet openings 311 in order to enable an additional adjustment of the coolant quantity and even distribution.

A thermostat valve 313 or an electric switch valve for controlling the additional cooling circulation through the second cooling chamber 309, especially in the engine heat-up phase, can be provided in the area of the coolant outlet 312 from the second cooling chamber 309 before the opening into the coolant circulation or into the first cooling chamber 304 of the cylinder head 301.

The invention claimed is:

1. A one-piece liquid-cooled cylinder head and liquid-cooled exhaust manifold comprising:

a cylinder head defining a gasket surface for attachment to a cylinder block of an internal combustion engine, a first internal cooling chamber, a first inlet channel extending from said gasket surface to said first cooling chamber, and a first outlet channel extending away from said first cooling chamber, an exhaust manifold defining a second internal cooling chamber spaced from said first cooling chamber, a second inlet channel extending from said gasket surface to said second cooling chamber, and a second outlet channel extending away from said second cooling chamber, said second outlet channel connecting with said first cooling chamber, and a valve in one of said first inlet channel, said first outlet channel, said second inlet channel and said second outlet channel, said valve being selected from a thermostat valve and an electric switching valve, so that liquid flow through said first and second cooling chambers can be separately adjusted.

2. A one-piece liquid-cooled cylinder head and liquid-cooled exhaust manifold comprising:

a cylinder head defining a gasket surface for attachment to a cylinder block of an internal combustion engine, a first internal cooling chamber, a first inlet channel extending from said gasket surface to said first cooling chamber, and a first outlet channel extending away from said first cooling chamber, an exhaust manifold defining a second internal cooling chamber spaced from said first cooling chamber, a second inlet channel extending from said gasket surface to said second cooling chamber, and a second outlet channel extending away from said second cooling chamber, and a thermostate valve in one of said first inlet channel, said first outlet channel, said second inlet channel and said second outlet channel, so that liquid flow through said first and second cooling chambers can be separately adjusted.

3. A one-piece liquid-cooled cylinder head and liquid-cooled exhaust manifold comprising:

a cylinder head defining a gasket surface for attachment to a cylinder block of an internal combustion engine, a first internal cooling chamber, a first inlet channel extending from said gasket surface to said first cooling chamber, and a first outlet channel extending away from said first cooling chamber, an exhaust manifold defining a second internal cooling chamber spaced from said first cooling chamber, a second inlet channel extending from said gasket surface to said second cooling chamber, and a second outlet channel extending away from said second cooling chamber, a cylinder head gasket which provides a throttle opening at the second inlet channel, and a valve in one of said first inlet channel, said first outlet channel, said second inlet channel and said second outlet channel, said valve being selected from a thermostat valve and an electric switching valve, so that liquid flow through said first and second cooling chambers can be separately adjusted.

* * * * *

UNITED STATES PATENT AND TRADEMARK OFFICE

CERTIFICATE OF CORRECTION

PATENT NO. : 8,555,627 B2
APPLICATION NO. : 11/989000
DATED : October 15, 2013
INVENTOR(S) : Knollmayr et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1241 days.

Signed and Sealed this
Fifteenth Day of September, 2015

Michelle K. Lee

Michelle K. Lee
*Director of the United States Patent and Trademark Office*